US010159302B2

(12) United States Patent
Carlson et al.

(10) Patent No.: US 10,159,302 B2
(45) Date of Patent: Dec. 25, 2018

(54) FOOTWEAR HAVING AN ADJUSTABLE LENGTH FEATURE

(71) Applicant: Mizuno USA, Inc., Norcross, GA (US)

(72) Inventors: Jess Paul Carlson, Cleveland, OH (US); David Michael Pehar, Cleveland, OH (US); Jeffrey Silver Taggart, Cleveland, OH (US)

(73) Assignee: Mizuno USA, Inc., Norcross, GA (US)

( * ) Notice: Subject to any disclaimer, the term of this patent is extended or adjusted under 35 U.S.C. 154(b) by 262 days.

(21) Appl. No.: 14/986,257

(22) Filed: Dec. 31, 2015

(65) Prior Publication Data

US 2017/0188656 A1 Jul. 6, 2017

(51) Int. Cl.
*A43B 3/26* (2006.01)

(52) U.S. Cl.
CPC ..... *A43B 3/26* (2013.01)

(58) Field of Classification Search
CPC ..... A43B 3/26; A43B 13/181; A43B 13/187; A43B 23/088; A43B 5/0427; A43B 5/1608; A43C 11/14
USPC ..... 36/97
See application file for complete search history.

(56) References Cited

U.S. PATENT DOCUMENTS 3,389,481 A * 6/1968 England ..... A43B 3/26 36/97
5,400,484 A * 3/1995 Gay ..... A44B 11/20 24/593.11
5,659,980 A * 8/1997 Lin ..... A43B 3/26 36/105
5,794,362 A * 8/1998 Polk, III ..... A43B 3/26 280/7.13
6,045,144 A * 4/2000 Wong ..... A43B 3/26 280/11.224
6,138,385 A * 10/2000 Jungkind ..... A43B 1/0018 36/102
6,189,239 B1 * 2/2001 Gasparovic ..... A43B 3/30 36/102
6,438,872 B1 * 8/2002 Chil ..... A43B 1/0072 36/102
6,497,420 B2 * 12/2002 Ricci ..... A43B 1/0072 280/11.16
6,718,658 B2 * 4/2004 Karasawa ..... A43B 3/06 36/100
6,916,027 B2 * 7/2005 Chen ..... A43B 3/26 280/11.26
6,918,602 B2 * 7/2005 Lu ..... A43B 5/1608 280/11.26

(Continued)

*Primary Examiner* — Alissa Tompkins
*Assistant Examiner* — Griffin Hall
(74) *Attorney, Agent, or Firm* — Troutman Sanders LLP; Daniel Sharpe

(57) ABSTRACT

An article of footwear including a length adjustment mechanism is disclosed. The article of footwear can include a sole portion with one or more anchors connected to the sole portion. The article of footwear can also include a heel cup capable of moving between a fore position and an aft position. This can be accomplished using one or more length adjustment mechanisms that each slidably engage the one or more anchors, such that they have an unlocked state and a locked state. In the unlocked state, the heel cup can move with respect to the one or more anchors; and in the locked state cannot move with respect to the one of more anchors.

14 Claims, 5 Drawing Sheets

(56) References Cited

U.S. PATENT DOCUMENTS

| | | | | |
|---|---|---|---|---|
| 7,055,268 | B2 * | 6/2006 | Ha | A43B 1/0018 36/51 |
| 7,137,212 | B2 * | 11/2006 | Miller | A43B 1/0072 36/97 |
| 7,152,865 | B2 * | 12/2006 | Chen | A43B 5/1608 280/11.26 |
| 7,407,168 | B2 * | 8/2008 | Lee | A63C 17/06 280/11.26 |
| 7,581,337 | B2 * | 9/2009 | Miller | A43B 1/0072 36/102 |
| 8,011,119 | B2 * | 9/2011 | Tvoua | A43B 3/26 36/11.5 |
| 8,029,003 | B2 * | 10/2011 | Chen | A63C 17/04 280/11.221 |
| 8,104,195 | B2 * | 1/2012 | Cavasin | A43B 3/26 36/117.3 |
| 8,938,890 | B2 * | 1/2015 | Raghuprasad | A43B 3/26 36/55 |
| 2001/0015534 | A1 * | 8/2001 | Iverson | A43B 3/26 280/11.26 |
| 2002/0171210 | A1 * | 11/2002 | Sauter | A43B 3/26 280/11.221 |
| 2008/0296871 | A1 * | 12/2008 | Hsieh | A43B 3/26 280/607 |
| 2013/0340292 | A1 * | 12/2013 | Cook | A43B 5/14 36/131 |
| 2015/0366288 | A1 * | 12/2015 | Miller | A43B 3/26 36/97 |
| 2017/0056754 | A1 * | 3/2017 | Yu | A43B 5/00 |

* cited by examiner

FOOTWEAR HAVING AN ADJUSTABLE LENGTH FEATURE

BACKGROUND OF THE INVENTION

1. Field of the Invention

The present invention relates generally to articles of footwear having an adjustable length, and more particularly to articles of footwear capable of allowing a wearer to selectively alter the length of an article of footwear.

2. Background of Related Art

The fit of articles of footwear, such as athletic shoes, is often critical to the wearer's performance or comfort. Most footwear is sold in a discrete number of sizes, with each size having a characteristic length and width. Such a system typically provides enough variety for most people to find a size that fits well enough to wear without significant discomfort. However, because the lengths and widths are inextricably linked by the discrete sizes, some people find their closest fit size is either slightly too long or too short for one or both of a person's feet.

Particularly in the case of children and adolescents, rapidly (and/or unevenly) growing feet may cause a shoe or pair of shoes to be too small in a short period of time. The potential cost of buying sizes that are too large for children and adolescents to "grow into" may be that injuries occur or performance and/or comfort are limited. Relatedly, many people of all ages have left and right feet that are slightly different, potentially making an identically sized matched pair less than ideal. Compromising on the fit of one shoe for the benefit of the other is a common occurrence, and one that can potentially be an issue for people with a larger than usual size discrepancy or those that desire a closer, consistent fit on both of their feet.

Further, a number of factors may cause a wearer to desire a longer or shorter fit at different times. For example, a person's foot is known to change size in response to a number of factors such as the time of day, the temperature, or a medical condition. Even aside from actual changes in a person's foot size, other factors may influence the desired fit such as the type of sock worn, braces or wraps on the foot or ankle, and/or personal preference for different fits in different situations.

For instance, winter runs may call for thicker socks than summer runs, and this sock difference may slightly change the size of the shoe needed to accommodate the wearer's foot. In the event of a minor injury or during recovery from an injury, one shoe may need to be larger than the other to accommodate a brace or wrap on the injured foot or ankle. Particularly in the event that a wearer has properly fitting shoes to begin with, the addition of extra layers on the foot and ankle may cause a poor fit. In some cases, athletes may simply have a preference for a tighter fit during a game, competition, or race than they desire for non-competition activities like warm-ups. All these reasons and more evidence a need to provide an article of footwear that allows a wearer to adjust the length to suit their needs.

Past attempts to address this need have been met with limited success. Mechanisms such as pumps and lacing/strapping systems have been employed in the past to provide some level of adjustability. These mechanisms each have shortcomings. Some of these shortcomings can be in one or more of: durability, ease of adjustment, comfort, stability, and range of adjustment. In the case of an athletic shoe, shortcomings in one or more of these areas may result in the wearer suffering a loss of performance, reduced comfort, or a shortened lifespan of the shoe.

What is needed, therefore, is an article of footwear that allows the wearer to adjust a dimension of the shoe, such as the length. The article should provide for simple and reliable adjustment, while preserving the comfort and durability of the article. It is to such an article of footwear that embodiments of the present invention are primarily directed.

BRIEF SUMMARY OF THE INVENTION

Embodiments of the present disclosure relate to an article of footwear having an adjustable length. In some embodiments, an article of footwear according to the present disclosure can include a length adjustment mechanism. The article can have a sole, one or more anchors connected to the sole portion, a heel cup, and one or more length adjustment mechanisms. The heel cup can be movable between a fore position for an effectively shorter article, and an aft position for an effectively longer article. The one or more length adjustment mechanisms can each be connected to one or more of the anchors. Each length adjustment mechanism can have an unlocked state (in which heel cup is movable with respect to the anchors), and a locked state (in which heel cup is not movable with respect to the anchors).

Each of the one or more length adjustment mechanisms can have an adjustment frame attached to the heel cup, and a retention mechanism. The length adjustment mechanisms can also include a locking tab connected to the adjustment frame, such that the locking tab abuts the retention mechanism when the length adjustment mechanism is in a locked state. In some embodiments, the locking tab is pivotally connected to the adjustment frame and is movable from a stowed position to a deployed position. In the stowed position, the locking tab may be substantially within the adjustment frame, and in the deployed position it may protrude. The locking tab may also have a locking tab detent such that the locking tab detent contacts the adjustment frame in the stowed position to aid in keeping the locking tab in position.

The anchors in the sole can have a set of anchor teeth and an anchor track portion. In some embodiments, the length adjustment mechanisms can be attached to the anchor track portion to keep the length adjustment mechanisms from moving up-and-down or side-to-side. The engagement portion of the retention mechanism may have engagement teeth that are sized and shaped to mate with the set of anchor teeth. In the unlocked state of some embodiments, the engagement teeth can move in a direction substantially parallel to the set of anchor teeth, while in the locked state of such embodiments, they cannot do so because of the locking tab's position abutting the retention mechanism.

A heel strap may also be provided to an article according to the present disclosure. The heel strap can be connected to both the sole portion and an upper portion of the article of footwear. This way, the heel strap can cover any portion of the article between the heel cup and the sole that becomes exposed as the heel cup moves between the fore and aft positions.

These and other objects, features, and advantages of the present invention will become more apparent upon reading the following specification in conjunction with the accompanying drawing figures.

DETAILED DESCRIPTION OF THE INVENTION

Embodiments of the present invention relate generally to articles of footwear, and more particularly to articles of footwear including an adjustable length mechanism. In some embodiments, an upper portion of an article of footwear can have its length adjusted by manipulating a mechanism located in the heel portion of the article. In some embodiments, the length adjustment mechanisms can be located on the sides of the heel portion of the shoe, and can allow a wearer to manipulate locking tabs and move the inner heel cup forward towards the toe, or backward away from the toe. This movement effectively lengthens or shortens the length dimension of the upper portion of the article of footwear, and can provide the wearer with an improved or desired fit.

To simplify and clarify explanation, the invention is described herein as an athletic shoe having a length adjustment feature. One skilled in the art will recognize, however, that the invention is not so limited.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention.

As described above, a general problem with conventional footwear is that it is sold in a discrete number of sizes, with each size having a characteristic length and width. While this is economical for manufacturers and retailers, it often means that consumers do not get an optimal fit. A poorly fitting article of footwear can have a number of adverse effects ranging from mild discomfort to serious injury. The present disclosure relates to solutions to the problem of footwear fit that is durable, easy to adjust, and comfortable.

As shown in FIGS. 1-7, embodiments of the present disclosure can comprise an article of footwear having an adjustable length feature. More specifically, embodiments of the present disclosure can comprise an athletic shoe that enables a wearer to adjust the overall length of the shoe to achieve a desired fit. The adjustable shoe can also comprise mechanisms for providing varying degrees of adjustment depending on, for example, the activity for which the shoe is intended.

Figure 1:
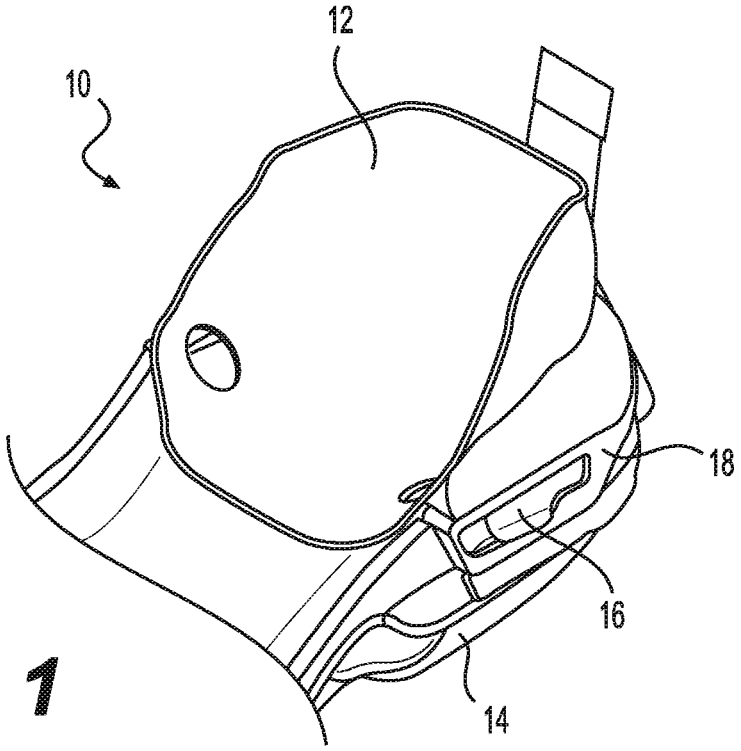
FIG. 1 depicts a perspective view of the heel region of an article of footwear having an adjustable length, in accordance with some embodiments of the present disclosure.
Figure 2:
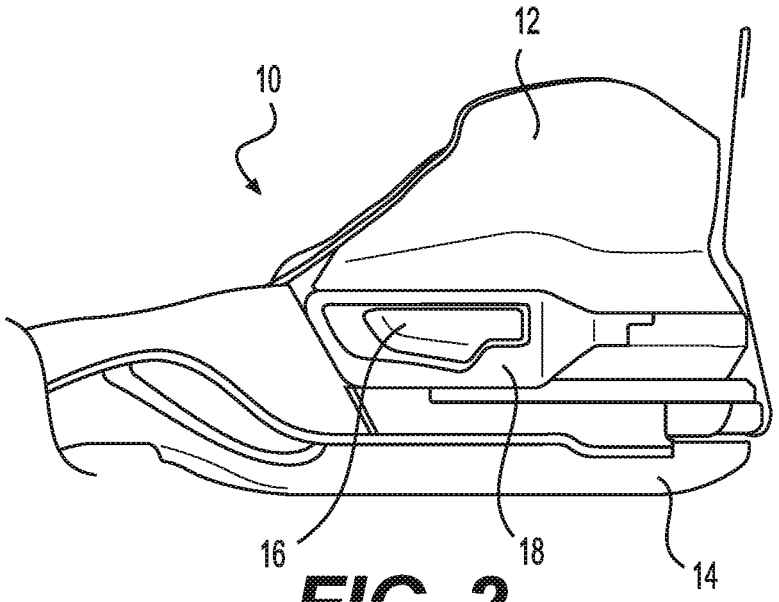
FIG. 2 depicts a side view of the article of footwear having an adjustable length of FIG. 1.

As shown in FIGS. 1 and 2, heel portion 10 of an athletic shoe can include a heel cup 12, sole 14, locking tabs 16, and adjustment frames 18. In some embodiments, heel cup 12 can be connected to adjustment frames 18 such as by screws or adhesives. In some embodiments, heel cup 12 and adjustment frames may be co-molded or unitarily formed. Adjustment frames 18 in turn engage sole 14 by way of anchors 20 connected to or embedded in sole 14 (illustrated in FIGS. 3 and 4). During normal wear or use, locking tabs 16 can be stowed substantially inside adjustment frames 18 in order to prevent accidental contact with objects and surfaces that may cause locking tabs 16 to move to the deployed position unintentionally.

Figure 3:
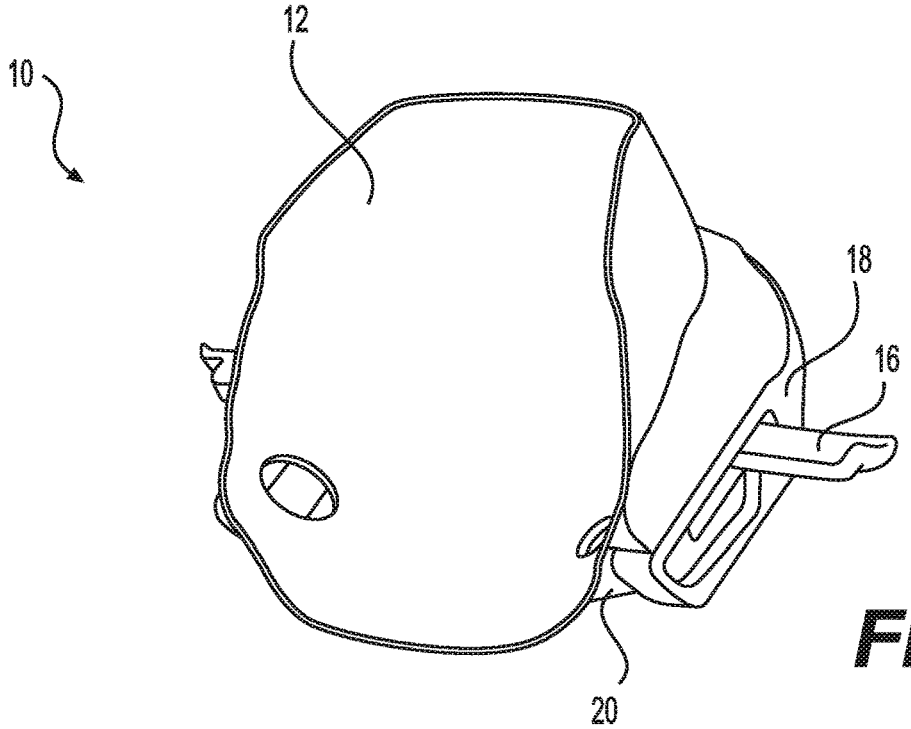
FIG. 3 depicts a perspective view of the heel portion of the article of footwear having an adjustable length of FIG. 1.
Figure 4:
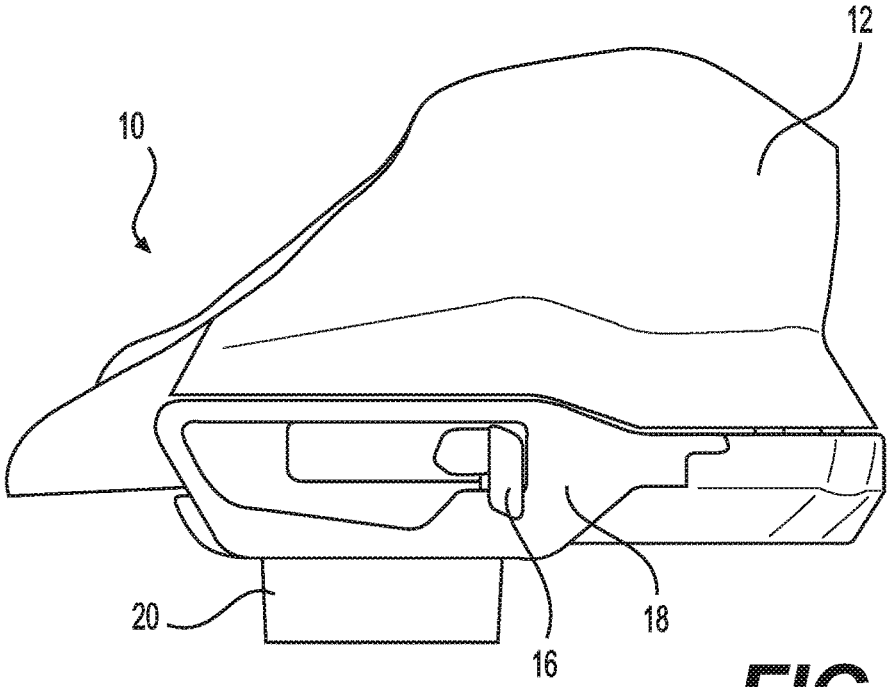
FIG. 4 depicts a side view of the heel portion of FIG. 3.

FIGS. 3 and 4 depict heel portion 10 in an unlocked state, as indicated by the locking tabs 16 being in a deployed position. In the deployed position, locking tabs 16 protrude outwardly from adjustment frames 18. In order to move from the stowed position to the deployed position, the wearer may use their fingers to pull locking tabs 16 out from adjustment frames 18. In some embodiments, locking tabs 16 pivot outward about a connection between the rearmost (away from the toe) end of locking tabs 16 and adjustment frames 18.

Figure 5:
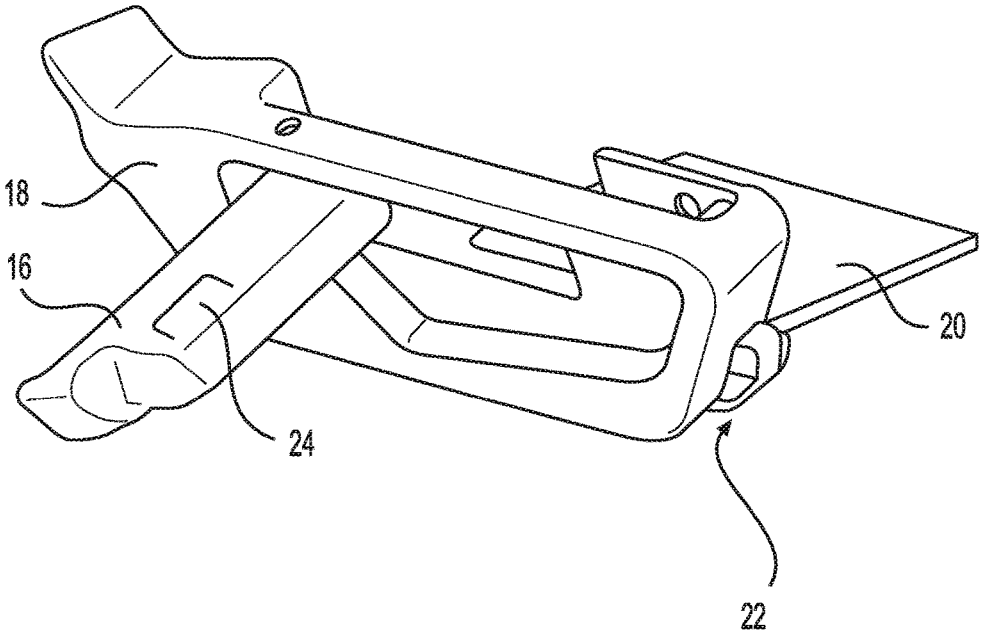
FIG. 5 depicts a perspective view of one side of the length adjustment mechanism, in accordance with an embodiment of the present disclosure.

FIG. 5 shows the main components of the length adjustment mechanism without the sole or heel cup portions attached. As illustrated in FIG. 5, anchor track portion 22 of anchor 20 engages adjustment frame 18. Anchor track 22 may provide a stable connection between anchor 20, and adjustment frame 18 such that adjustment frame 18 can only move in the forward or backward direction when in the unlocked position. In some embodiments, locking tab detent 24 can be present on a surface of locking tab 16 in order to selectively retain locking tab 16 in the stowed position. Locking tab detent 24 can cooperate with a corresponding portion of adjustment frame 18, such as a divot or depression, in order to prevent undesired deployment of locking tabs 16. In addition to or in lieu of locating locking tab detent 24 on locking tab 16, a locking tab detent can be located on a surface of adjustment frame 18, and cooperate with a divot or depression on locking tab 16.

In some embodiments, anchor 20 can be attached to sole 14 at an angle. This arrangement can potentially provide some spring or energy return to a wearer during the stride. Anchor 20 could also be integrally formed into sole 14, such that this energy return is reduced or not provided. However in many athletic endeavors, energy return can both provide comfort as well as aid in athletic performance. By varying the material properties of anchor 20 as well as the angle and manner of attachment to sole 14, varying degrees of springiness and energy return may be achieved.

Figure 6:
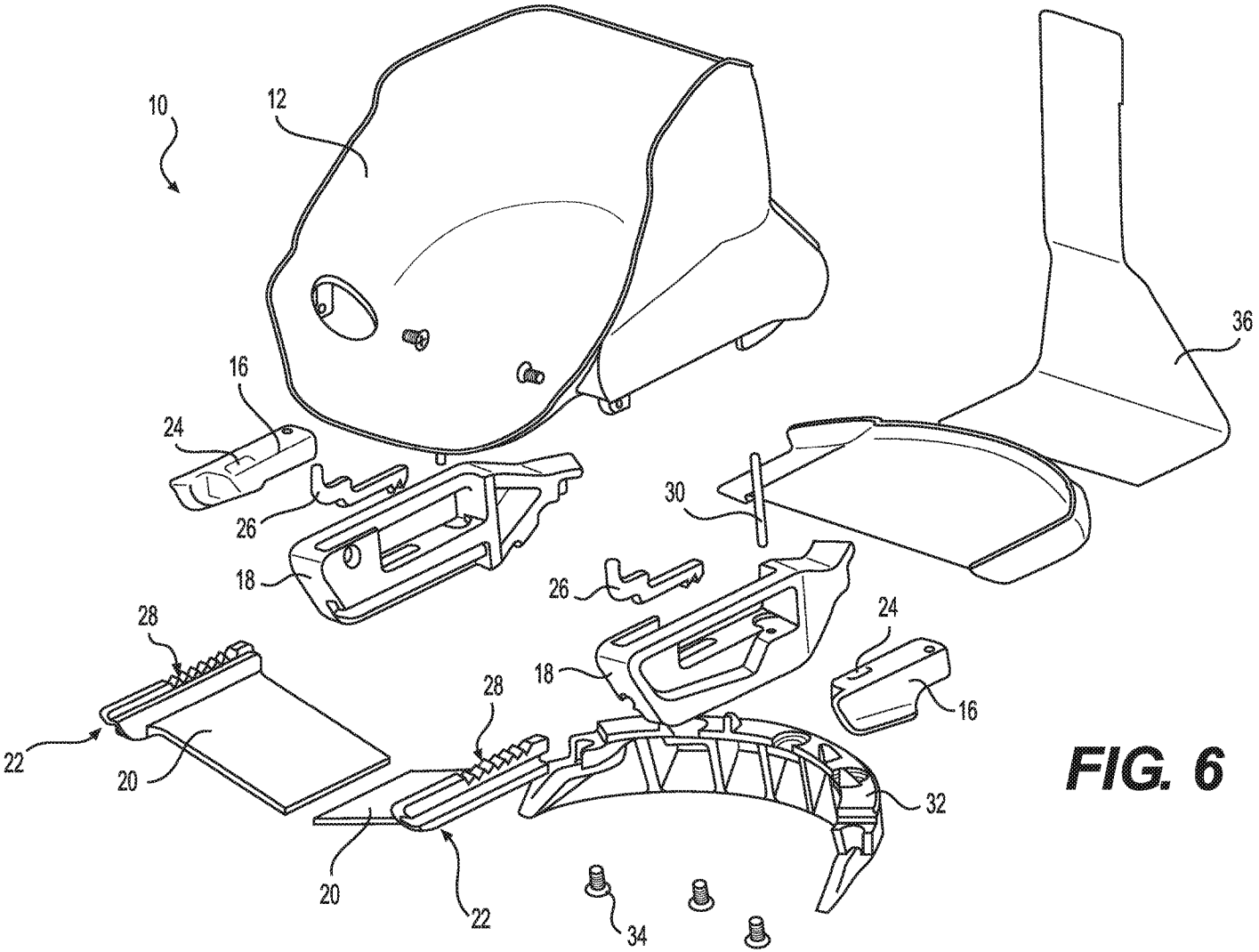
FIG. 6 depicts an exploded view of the heel portion assembly of FIG. 3.

An exploded view of heel portion 10 is depicted in FIG. 6 to reflect each component of the assembly. Retention mechanism 26 resides in adjustment frame 18, and engages anchor teeth portion 28 of anchor track portion 22 of anchor 20. In some embodiments, teeth on retention mechanism 26 mate with anchor teeth 28. The details of the function of retention mechanism 26 and anchor teeth 28 will be discussed in greater detail below with respect to FIGS. 7A-7C.

The exploded view of FIG. 6 shows pivoting pin 30, which can attach locking tab 16 to adjustment frame 18 by passing through both components. The use of pin 30 provides a robust connection between locking tab 16 and adjustment frame 18 that can survive thousands of deployment/stowing cycles. In addition to or in lieu of pin 30, other durable ways of connecting locking tab 16 to adjustment frame 18 may also be used. The result can be that locking tabs 16 are then capable of selectively pivoting outwardly as discussed above. Anchors 20 are connected to sole heel portion 32 by the sole 14 (not shown in FIG. 6). Anchors 20 and sole heel portion 32 may each be connected to the sole by screws 34, adhesives, or by any other suitable method.

Figure 7A:
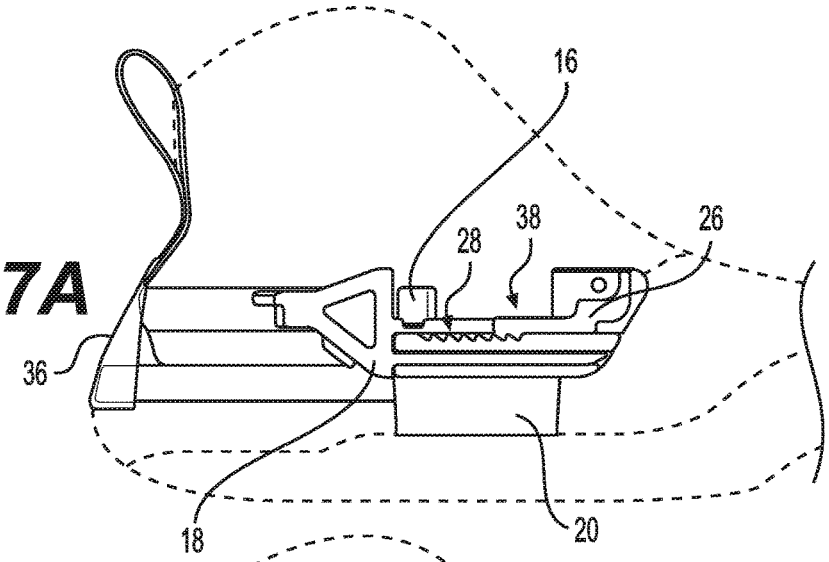
FIG. 7A depicts a side view of the article of footwear of FIG. 1 in its shortest position.
Figure 7B:
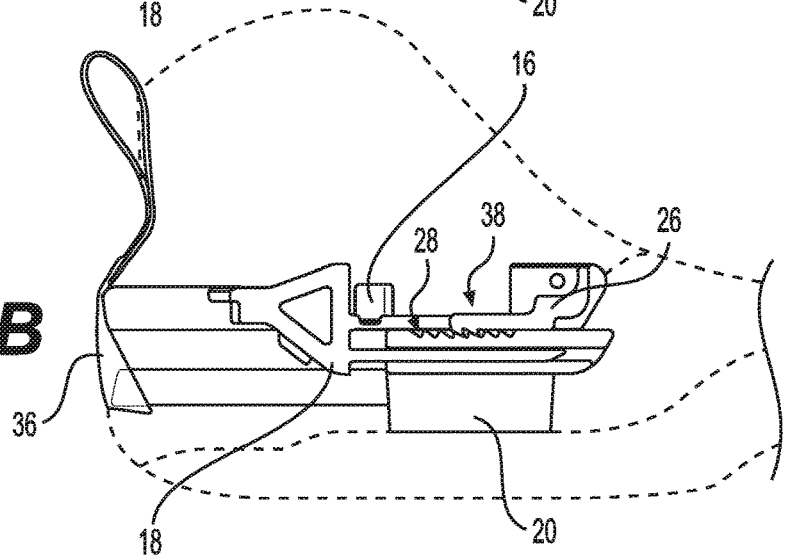
FIG. 7B depicts a side view of the article of footwear of FIG. 1 in an intermediate position.
Figure 7C:
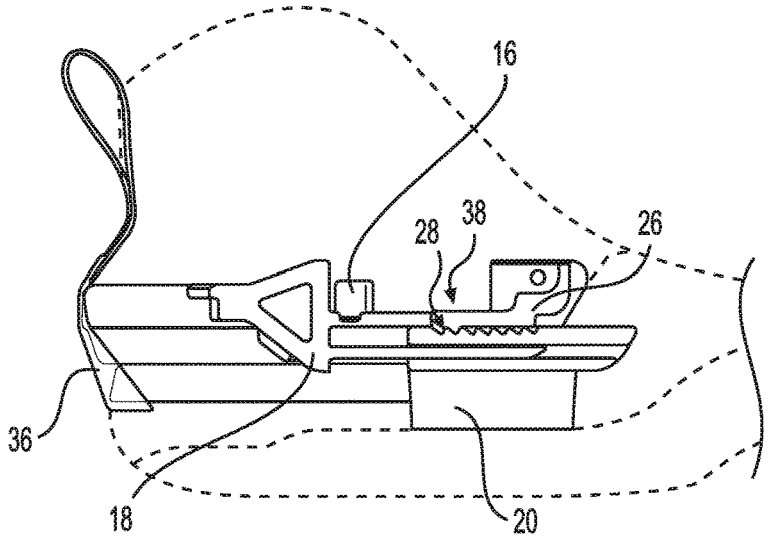
FIG. 7C depicts a side view of the article of footwear of FIG. 1 in its longest position.

In some embodiments, the gap between heel cup 12 and sole heel portion 32 may be covered by heel strap 36. Heel strap 36 can be nylon, or any other sufficiently flexible and strong material to help prevent the entry of debris or foreign objects in to the gap created by heel cup 12 moving forwards with respect to sole heel portion 32. By covering this gap, the mechanism may be made more durable and avoid obstructions that would prevent normal operation or cause damage to the mechanism. FIGS. 7A-7C further illustrate the operation of heel strap 36.

In some embodiments, as in FIGS. 7A-7C, heel portion 10 may have various states of length adjustment. FIG. 7A represents the shortest position of heel portion 10. In this configuration, the overall length of the interior cavity of the athletic shoe will be at its shortest, as may be indicated by retention mechanism 26 being positioned at the fore end of the anchor teeth portion 28. FIG. 7B represents an intermediate position of heel portion 10. In this configuration, the overall length of the interior cavity of the athletic shoe will be longer than at its shortest, but shorter than the longest position depicted in FIG. 7C. In the configuration of FIG. 7C, the overall length of the interior cavity of the athletic shoe will be at its longest, as may be indicated by retention mechanism 26 reaching the aft end of the anchor teeth portion 28.

In the embodiment of FIGS. 7A-7C, locking tabs 16 are shown in the unlocked position. In this position, locking tabs 16 may not abut retention mechanisms 26. Engagement portion 38 of retention mechanisms 26 may have one or more teeth sized and shaped to cooperate with anchor teeth 28. Without locking tabs 16 abutting retention mechanisms 26, engagement portion 38 is able to flex or rise slightly to allow retention mechanism 26 (and adjustment frame 18) to slide relative to anchor teeth 28 when a forward or backward force is applied. As a result of this arrangement and the relative freedom of motion in the fore-aft direction, adjustment frame 18 (and connected heel cup 10) is capable of moving forward and backward relative to sole 14.

As heel cup 10 moves with respect to sole 14, the user may receive tactile feedback such as feeling the 'clicks' associated with the teeth on the engagement portion sliding over the anchor teeth. In some embodiments, the teeth are sized and shaped to allow the force necessary to move heel cup 10 forward and backward to be substantially the same. Or the teeth may be designed to allow movement in one direction, such as backward, to require more force than forward motion.

In some applications, it may be desired that locking tabs 16 be a single piece to lock or unlock both sides of heel cup 10. Such arrangements may require a wearer to slide a locking tab forward or backward around the back of the heel or below the sole. This type of one-piece locking and unlocking may require more material to be used so that the mechanism can address both sides of the heel, and this may add weight and complexity to the shoe. In some embodiments, locking tabs 16 are provided with a linking component that allows both tabs to be manipulated at a single touch point. Other possible solutions to this weight and complexity issue could include only having locking on one side of the heel, but this may result in undesired durability or other related issues. In some embodiments, the locking tabs may also be slidably engaged with the mechanism such that rather than pivoting to selectively lock and unlock the retention mechanisms, they are instead translated. These and other arrangements as known in the art may be used to selectively constrain the retention mechanisms.

While several possible embodiments are disclosed above, embodiments of the present invention are not so limited. For instance, while several possible configurations have been disclosed, other suitable mechanism configurations and designs could be selected without departing from the spirit of embodiments of the disclosure. In addition, the location and configuration used for various features of embodiments of the present invention can be varied according to a particular article of footwear that requires a variation due to, for example, the size, necessary features, the wearer's preference, or cost considerations. Variations of a length adjustment feature according to the present disclosure may be incorporated into any desired article of footwear, including but not limited to athletic shoes, roller skates, ski bindings, and boots. Such changes are intended to be embraced within the scope of the invention.

The disclosed article including a length adjustment feature may also include other adjustable features as known in the art. Such an article is contemplated, and could potentially aid the wearer by offering additional adjustability. Additional features may be combined with the disclosed mechanism without departing from the scope of this disclosure.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

The invention claimed is:

1. An article of footwear including a length adjustment feature, comprising:

a sole portion;

one or more anchors connected to the sole portion;

a heel cup, the heel cup being movable between at least a fore position and an aft position; and one or more length adjustment mechanisms that each engage at least a portion of the one or more anchors, the one or more length adjustment mechanisms having both an unlocked state in which heel cup is movable with respect to the one or more anchors, and a locked state in which heel cup is not movable with respect to the one of more anchors;

the one or more length adjustment mechanisms comprising:

a retention mechanism including one or more engagement portions;

an adjustment frame attached to the heel cup; and a locking tab pivotally connected to the adjustment frame;

wherein the locking tab abuts the retention mechanism when one or more of the length adjustment mechanisms is in the locked state;

wherein the one or more anchors further comprise:

a set of anchor teeth;

an anchor track portion; and wherein the one or more length adjustment mechanisms engage the anchor track portion to restrict relative motion in one or more directions.

2. The article of footwear of claim 1, wherein the locking tab is movable from a stowed position to a deployed position, and wherein the locking tab is substantially within the adjustment frame when it is in the stowed position, and protrudes therefrom when it is in the deployed position.

3. The article of footwear of claim 2, wherein the locking tab further comprises:

a locking tab detent on a surface of the locking tab;

wherein the locking tab detent contacts the adjustment frame in the stowed position to maintain the locking tab in the stowed position.

4. The article of footwear of claim 1, wherein the engagement portion of the retention mechanism comprises one or more engagement teeth being sized and shaped to engage the set of anchor teeth.

5. The article of footwear of claim 4, wherein in the unlocked state, the one or more engagement teeth are capable of moving in a direction substantially parallel to the set of anchor teeth.

6. The article of footwear of claim 4, wherein in the locked state, the one or more engagement teeth are incapable of moving with respect to the anchor teeth due to the locking tab abutting the retention mechanism.

7. The article of footwear of claim 1, further comprising:

a heel strap connected to both the sole portion and an upper portion of the article of footwear;

wherein the heel strap is configured to cover the portion of the article between the heel cup and the sole in both the fore and aft positions.

8. An athletic shoe including a length adjustment feature, comprising:

a sole portion;

a first anchor and a second anchor each connected to the sole portion;

an upper portion attached to the sole portion such that the upper portion can expand or contract generally in an axial direction; and a first length adjustment mechanism and a second length adjustment mechanism that engage at least a portion of the first and second anchors, the first and second length adjustment mechanisms having both an unlocked state in which the upper portion is movable with respect to the first and second anchors, and a locked state in which the upper portion is not movable with respect to the first and second anchors;

each of the first and second length adjustment mechanisms comprising:

a retention mechanism including one or more engagement portions;

an adjustment frame attached to the upper portion;

a locking tab pivotally connected to the adjustment frame;

wherein the locking tab abuts the retention mechanism when the length adjustment mechanism is in the locked state;

wherein each of the first and second anchors further comprise:

a set of anchor teeth;

an anchor track portion; and wherein each of the first and second length adjustment mechanisms engage the anchor track portion of a respective anchor in order to restrict the motion of the first and second length adjustment mechanisms with respect to the first and second anchors in one or more directions.

9. The athletic shoe of claim 8, wherein the locking tab is movable from a stowed position to a deployed position, and wherein the locking tab is substantially within the adjustment frame when it is in the stowed position and protrudes therefrom when it is in the deployed position.

10. The athletic shoe of claim 9, wherein the locking tab further comprises:

a locking tab detent on a surface of the locking tab;

wherein the locking tab detent contacts the adjustment frame in the stowed position to maintain the locking tab in the stowed position.

11. The athletic shoe of claim 8, wherein the engagement portion of the retention mechanism comprises one or more engagement teeth being sized and shaped to engage the set of anchor teeth.

12. The athletic shoe of claim 11, wherein in the unlocked state, the one or more engagement teeth are capable of moving in a direction substantially parallel to the set of anchor teeth.

13. The athletic shoe of claim 11, wherein in the locked state, the one or more engagement teeth are incapable of moving with respect to the anchor teeth due to the locking tab abutting the retention mechanism.

14. The athletic shoe of claim 8, further comprising:

a heel strap connected to both the sole portion and the upper portion of the shoe;

wherein the heel strap is configured to cover the portion of the article between the upper portion and the sole in both an expanded or contracted position of the upper portion.

* * * * *